US007014581B2

(12) United States Patent
Ng

(10) Patent No.: US 7,014,581 B2
(45) Date of Patent: Mar. 21, 2006

(54) SOUND AND LIGHT EMITTING INFLATABLE BALL

(76) Inventor: Wai-Man Ng, Flat 10, 32/F., Chun Lai House, Hang Chun Court, Cheung Sha Wan, Kowloon (HK)

( * ) Notice: Subject to any disclaimer, the term of this patent is extended or adjusted under 35 U.S.C. 154(b) by 0 days.

(21) Appl. No.: 10/765,441

(22) Filed: Jan. 27, 2004

(65) Prior Publication Data

US 2004/0162170 A1 Aug. 19, 2004

(51) Int. Cl.
*A63B 43/06* (2006.01)

(52) U.S. Cl. ..... 473/570

(58) Field of Classification Search ..... 473/570, 473/571, 604, 605
See application file for complete search history.

(56) References Cited

U.S. PATENT DOCUMENTS 3,229,976 A * 1/1966 Allen, Jr. ..... 473/570
3,935,669 A * 2/1976 Potrzuski et al. ..... 473/570
4,595,200 A * 6/1986 Shishido ..... 473/570
4,776,589 A * 10/1988 Yang ..... 473/570
5,102,131 A 4/1992 Remington et al.
5,236,383 A * 8/1993 Connelly ..... 473/570
5,609,411 A * 3/1997 Wang ..... 473/570
5,725,445 A 3/1998 Kennedy et al. ..... 473/570

* cited by examiner

*Primary Examiner*—Steven Wong
(74) *Attorney, Agent, or Firm*—Donald J. Ersler

(57) ABSTRACT

A sound emitting inflatable ball includes an inflatable casing, a first polar receptacle, a second polar receptacle, a sound emitting circuit, a power source and a sound emitting device. The inflatable casing forms a spherical ball, when fully inflated. An air nozzle extends from a periphery of the inflatable casing. The first polar receptacle is inserted into a periphery of the inflatable casing and the second polar receptacle is inserted into the periphery of the inflatable casing opposite the first polar receptacle. Preferably, the power source is retained in the first polar receptacle, and the shock sensor and the sound emitting device are retained in the second polar receptacle. At least two wires connect the power source to the shock sensor and the sound emitting device. A light emitting circuit and light emitting device may be suspended from the at least two wires.

20 Claims, 4 Drawing Sheets

SOUND AND LIGHT EMITTING INFLATABLE BALL

CROSS-REFERENCE TO RELATED APPLICATIONS

This patent application takes priority from Chinese patent application, serial number 03223626.3, filed on Feb. 13, 2003.

BACKGROUND OF THE INVENTION

1. Field of the Invention

The present invention relates generally to inflatable balls and more specifically to a sound and light emitting inflatable ball, which includes a replaceable power source.

2. Discussion of the Prior Art

The prior art provides numerous inflatable balls. U.S. Pat. No. 5,725,445 to Kennedy et al. discloses a flashing light pneumatic playball. The Kennedy et al. patent includes electronic circuitry that is suspended between two poles of the pneumatic playball. However, the Kennedy et al. patent does not provide a power source for the electronic circuitry that may be replaced. The Kennedy et al. patent also does not teach or suggest a sound emitting inflatable playball.

Accordingly, there is a clearly felt need in the art for a sound and light emitting inflatable ball, which includes a replaceable power source and emits sound when a shock sensor is activated.

SUMMARY OF THE INVENTION

The present invention provides a sound and light emitting inflatable ball, which includes a replaceable power source. The sound and light emitting inflatable ball (inflatable ball) includes an inflatable casing, a first polar receptacle, a second polar receptacle, a sound emitting circuit, a power source and a sound emitting device. The inflatable casing forms a spherical ball, when fully inflated. An air nozzle extends from a periphery of the inflatable casing, which allows the inflatable ball to be filled with air. Preferably, the air nozzle may be inserted below the periphery of the inflatable casing.

The first polar receptacle is inserted into a perimeter of the inflatable casing and the second polar receptacle is inserted into the perimeter of the inflatable casing opposite the first polar receptacle. However, the second polar receptacle may also be inserted into the inflatable casing in a position, which is not opposite the first polar receptacle. Preferably, a removable cap is attachable to an open end of each polar receptacle. Preferably, the power source is retained in the first polar receptacle, and the sound emitting circuit and the sound emitting device are retained in the second polar receptacle. However, only the power source needs to be stored in at least one of the first and second polar receptacles. At least two wires connect the power source to the sound emitting circuit and the sound emitting device. When a shock sensor of the sound emitting circuit is excited by an impact, the sound emitting device will emit some type of sound for a predefined period of time. A light flashing circuit and at least one light emitting device may be suspended from the at least two wires in substantially a middle of the inflatable ball. When the shock sensor is excited by an impact, the light will flash for a predefined period of time. Alternatively, the light may flash by activation of a switch.

Accordingly, it is an object of the present invention to provide a sound emitting inflatable ball, which includes a replaceable power source.

Finally, it is another object of the present invention to provide a sound emitting inflatable ball, which emits sound when a sound emitting device is activated.

These and additional objects, advantages, features and benefits of the present invention will become apparent from the following specification.

DETAILED DESCRIPTION OF THE PREFERRED EMBODIMENTS

Figure 1:
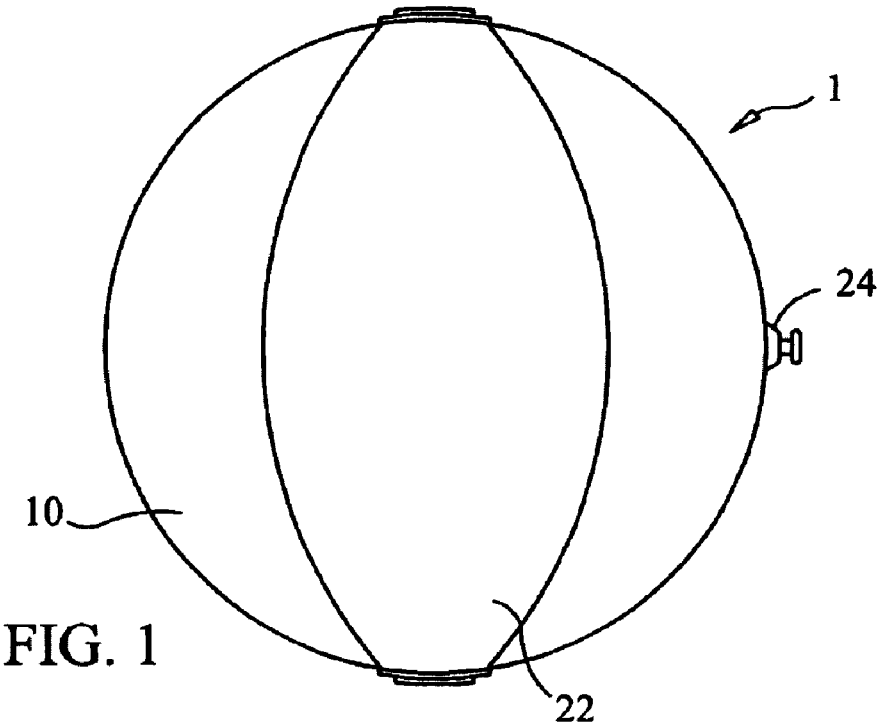
FIG. 1 is a front view of an inflatable ball in accordance with the present invention.
Figure 2:
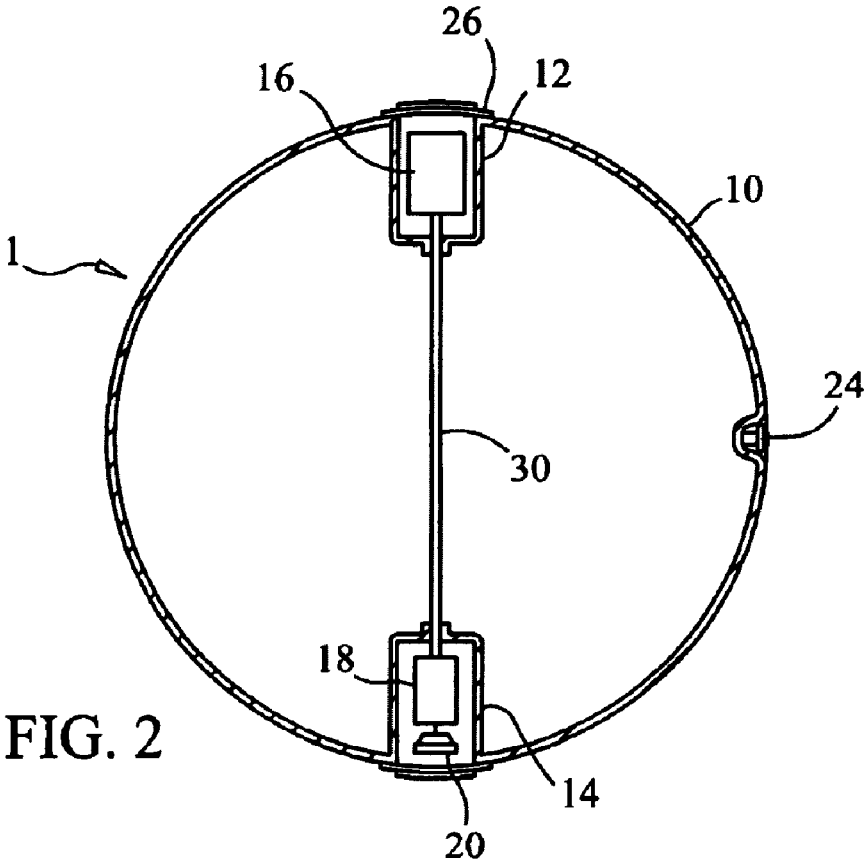
FIG. 2 is a cross sectional view of an inflatable ball in accordance with the present invention.
Figure 3:
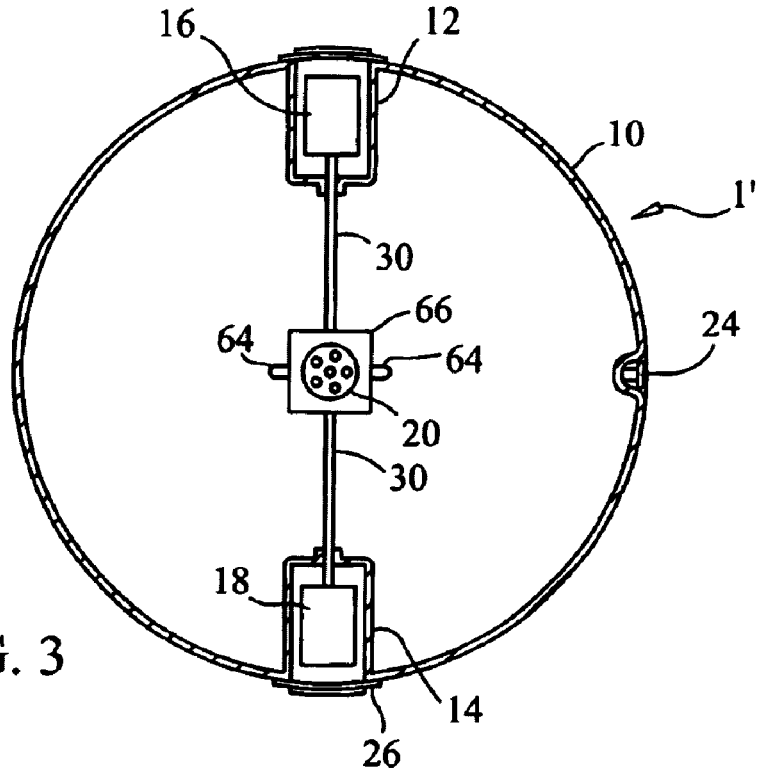
FIG. 3 is a cross sectional view of an inflatable ball with a light flashing circuit in accordance with the present invention.
Figure 6:
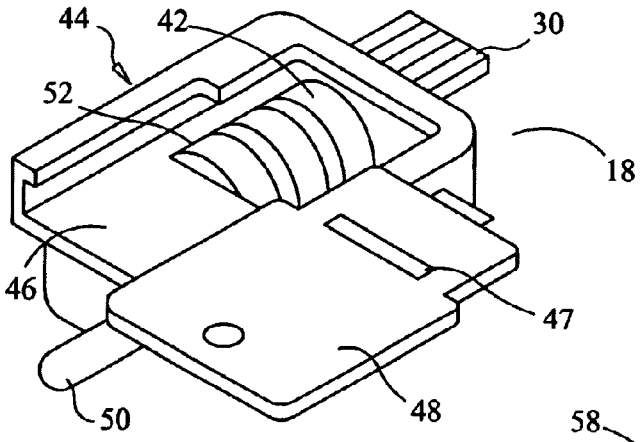
FIG. 6 is a partially exploded perspective view of a battery container of an inflatable ball in accordance with the present invention.
Figure 7:
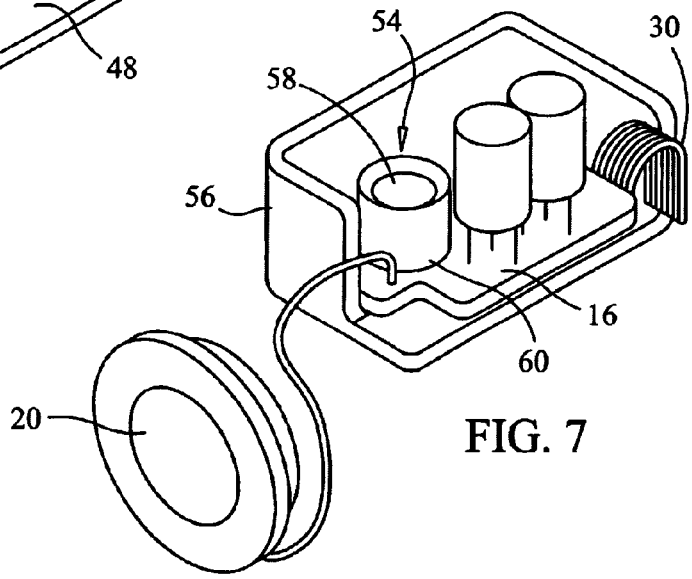
FIG. 7 is a perspective cutaway view of a sound emitting device of an inflatable ball in accordance with the present invention.

With reference now to the drawings, and particularly to FIG. 1, there is shown a front view of an inflatable ball 1. With reference to FIG. 2, 6 and 7, the inflatable ball 1 includes an inflatable casing 10, a first polar receptacle 12, a second polar receptacle 14, a sound emitting circuit 16, a power source 18 and a sound emitting device 20. The inflatable casing 10 forms a spherical ball, when fully inflated. The inflatable casing 10 is preferably fabricated by seaming at least two peripheral sections 22 together. The at least two peripheral sections 22 are preferably fabricated from a translucent material. An air nozzle 24 extends from a periphery of the inflatable casing 10, which allows the inflatable casing 10 to be filled with air. Preferably, the air nozzle 24 may be pushed below the outside periphery of the inflatable casing 10 as shown in FIGS. 2 and 3. Air nozzles that may be inserted below the outside periphery of the inflatable casing 10 are well know in the art.

Figure 4:
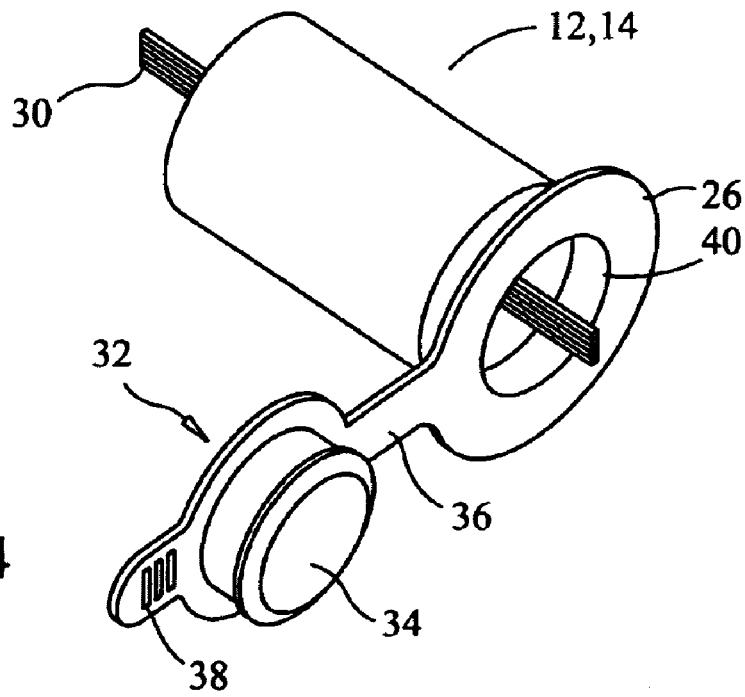
FIG. 4 is a front perspective view of a polar receptacle of an inflatable ball in accordance with the present invention.
Figure 5:
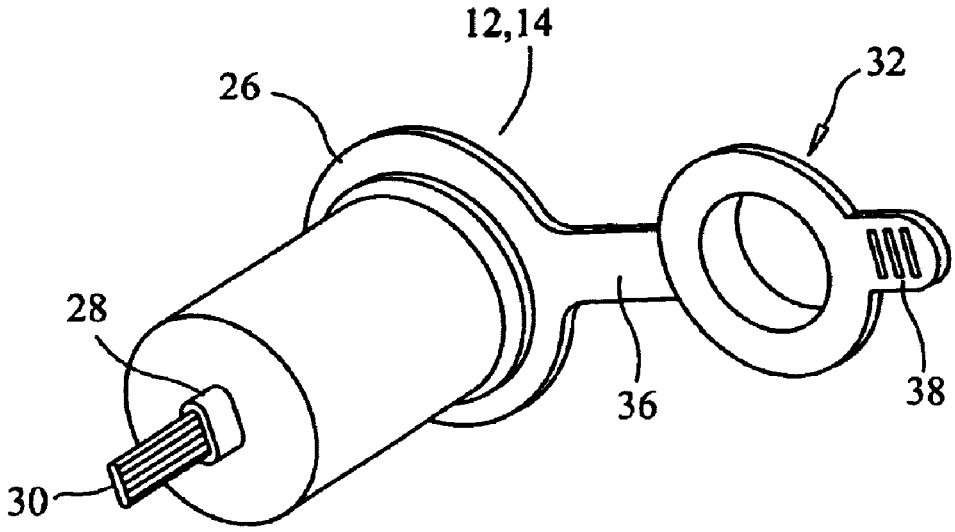
FIG. 5 is a rear perspective view of a polar receptacle of an inflatable ball in accordance with the present invention.

The first polar receptacle 12 is inserted into a first opening in the periphery of the inflatable casing 10 and the second polar receptacle 14 is inserted into a second opening in the periphery of the inflatable casing 10, preferably opposite the first polar receptacle 12. With reference to FIGS. 4–5, each polar receptacle preferably includes a peripheral end lip 26 disposed on an open end thereof. The peripheral end lip 26 is fastened to the inflatable casing 10 with any suitable attachment process, such as sonic welding. Each polar receptacle is shown as having a substantially round tubular cross section, but other shapes may also be used, such as square. A wire boss 28 is preferably formed on a bottom of each polar receptacle for at least two wires 30. A sealant is applied to the entrance of the wire boss 28 and the at least two wires 30 to prevent air from leaking out of the inflatable casing 10, through the wire boss 28.

A removable cap 32 preferably extends from the peripheral end lip 26. The removable cap 32 preferably includes a cap portion 34, a flexible hinge 36 and a lift tab 38. One end of the flexible hinge 36 extends from the peripheral end lip 26 and the cap portion 34 extends from the other end of the flexible hinge 36. The lift tab 38 extends from cap portion, preferably opposite the flexible hinge 36. The lift tab 38 allows the cap portion 34 to be removed from the, polar receptacle 12, 14. A perimeter of the cap portion 34 is sized to be received by an open end of a cavity 40 of each polar receptacle. Preferably, the sound emitting circuit 16 is retained in the first polar receptacle 12, and the power source 18 and the sound emitting device 20 are retained in the second polar receptacle 14. However, only the power source 18 needs to be stored in at least one of the first and second polar receptacles.

The power source 18 preferably includes at least one battery 42. The at least one battery 42 is retained in a battery case 44. The battery case 44 preferably includes a retention case 46, a case lid 48 and a pull tab 50. The retention case 46 includes a battery cavity 52 that is sized to receive the at least one battery 42 and an electrical connection to the at least two wires 30. The retention case 46 is structured to receive the case lid 48. The pull tab 50 extends from the retention case 46. The pull tab 50 may be used to withdraw the battery case 44 from the first polar receptacle 12 to replace the at least one battery 42 therein.

Figure 6A:
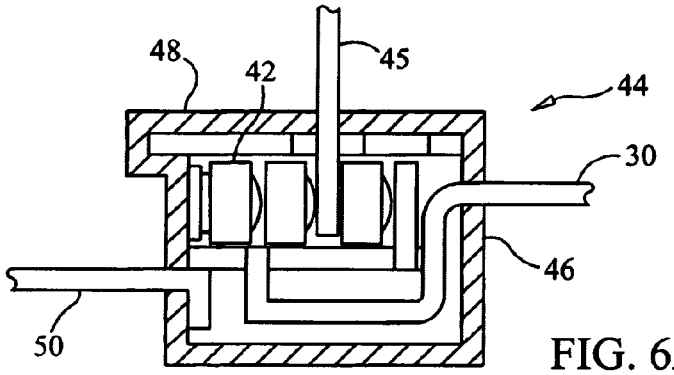
FIG. 6*a* is a cross sectional view of a battery container of an inflatable ball, illustrating an insulation tab in accordance with the present invention.

With reference to FIG. 6*a*, an insulation tab 45 is inserted through a insulator opening 47 in the case lid 48 to break the power connection between the at least one battery and a shock sensor 54 or a light flashing circuit (not shown). The insulation tab 45 is fabricated from a nonconductive material and acts as an on-off switch.

The sound emitting circuit 16 includes a shock sensor 54. The sound emitting circuit 16 is retained in a circuit case 56. The shock sensor 54 preferably includes a coiled spring 58 contained in a conductive tube 60, but other types of shock sensors may also be used. When impact occurs, the coiled spring 58 contacts the inner wall of the conductive tube 60, which triggers the sound emitting circuit 16. An impact typically occurs when the ball strikes the ground or is caught. The sound emitting circuit 16 activates the sound emitting device 20 for some predefined period of time. The sound emitting device 20 will emit some type of sound. The at least two wires 30 electrical connect the power source 18 to the sound emitting circuit 16 and the sound emitting device 20. Sound emitting circuits and sound emitting devices are well known in the art and need not be explained in detail.

With reference to FIG. 3, an inflatable ball 1' includes at least one light emitting device 64 and a light flashing circuit (not shown) retained in a light case 66. The light case 66 is suspended in substantially a middle of the inflatable ball 1' by the at least two wires 30. The sound emitting device 20 may also be retained by the light case 66. The light flashing circuit is preferably triggered by the shock sensor 54. The light flashing circuit will send power to the at least one light emitting device 64 for a predetermined period of time. Further, the light flashing circuit may also be located in the circuit case 56 on the same board as the shock sensor 54. The at least one light emitting device 64 may be located in at least one polar receptacle. The at least one light emitting device 64 may flash light when the insulation tab 45 is removed or flash light when an impact occurs. The choice between "continuous flashing" and "impact flashing" may be controlled with any suitable method, such as a switch located on the circuit board of the light flashing circuit.

Figure 3A:
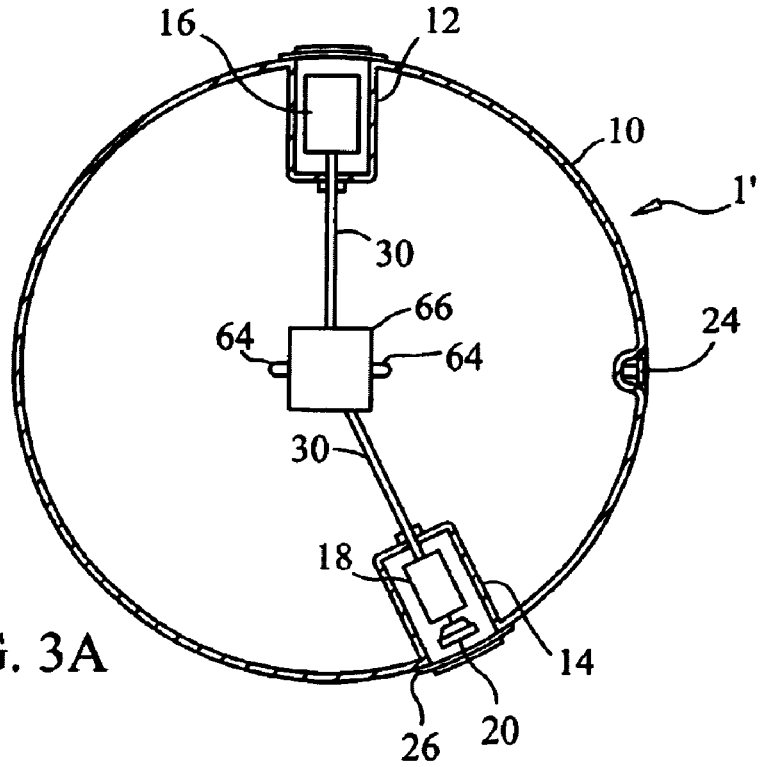
FIG. 3*a* is a cross sectional view of an inflatable ball with a light flashing circuit and with the second polar receptacle in a position, which is not opposite the first polar casing in accordance with the present invention.

With reference to FIG. 3*a*, the light case 66 suspended in the inflatable ball 1" by the at least two wires 30. However, the second polar receptacle 14 is not opposite or along the same axis as the first polar receptacle 12. The sound emitting device 20 is retained in the second polar receptacle 14, instead by the light case 66. The operation of the inflatable ball 1" is the same as the inflatable ball 1".

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method for fabricating a sound emitting inflatable ball, comprising the steps of:

providing an inflatable casing;

securing a first receptacle to a periphery of said inflatable casing, securing a second receptacle to said periphery of said inflatable casing substantially opposite said first receptacle;

retaining a power source in at least one of said first and second receptacles;

providing at least one of a sound emitting device and a light emitting device; and suspending at least one of said sound emitting device and said light emitting device in substantially a middle of said inflatable casing with at least two wires extending from said first and second receptacles.

2. The method for fabricating a sound emitting inflatable ball of claim 1, further comprising the step of:

providing a sound emitting circuit that activates said sound emitting device, triggering said sound emitting circuit with a shock sensor.

3. The method for fabricating a sound emitting inflatable ball of claim 1, further comprising the step of:

providing a light flashing circuit, triggering said light flashing circuit with a shock sensor such that said light emitting device emits light.

4. The method for fabricating a sound emitting inflatable ball of claim 1, further comprising the steps of:

terminating an open end of said first receptacle with a first removable cap; and terminating an open end of said second receptacle with a second removable cap.

5. The method for fabricating a sound emitting inflatable ball of claim 1, further comprising the step of:

forming an air nozzle on a periphery of said inflatable casing, said air nozzle being insertable below the periphery of said inflatable casing.

6. The method for fabricating a sound emitting inflatable ball of claim 1, further comprising the steps of:

providing at least one battery for said power source.

7. The method for fabricating a sound emitting inflatable ball of claim 6, further comprising the steps of:

replacing said at least one battery by removing said at least one battery from at least one of said first receptacle and said second receptacle.

8. The method for fabricating a sound emitting inflatable ball of claim 1, further comprising the steps of:

securing said second receptacle to said periphery of said inflatable casing opposite said first receptacle.

9. A method for fabricating a sound emitting inflatable ball, comprising the steps of:

providing an inflatable casing;

securing a first receptacle to a periphery of said inflatable casing, securing a second receptacle to said periphery of said inflatable casing substantially opposite said first receptacle;

retaining a power source in one of said first and second receptacles;

retaining a sound emitting circuit in the other one of said first and second receptacles, said sound emitting circuit activating said sound emitting device when an impact occurs; and connecting said power source to said sound emitting circuit with at least two wires through a middle of said inflatable casing.

10. The method for fabricating a sound emitting inflatable ball of claim 9, further comprising the step of:

triggering said sound emitting circuit with a shock sensor.

11. The method for fabricating a sound emitting inflatable ball of claim 9, further comprising the step of:

providing at least one light emitting device and a light flashing circuit, triggering said light flashing circuit with a shock sensor such that said at least one light emitting device emits light.

12. The method for fabricating a sound emitting inflatable ball of claim 9, further comprising the steps of:

terminating an open end of said first receptacle with a first removable cap; and terminating an open end of said second receptacle with a second removable cap.

13. The method for fabricating a sound emitting inflatable ball of claim 9, further comprising the step of:

forming an air nozzle on a periphery of said inflatable casing, said air nozzle being insertable below the periphery of said inflatable casing.

14. The method for fabricating a sound emitting inflatable ball of claim 9, further comprising the steps of:

providing at least one battery for said power source.

15. The method for fabricating a sound emitting inflatable ball of claim 14, further comprising the steps of:

replacing said at least one battery by removing said at least one battery from at least one of said first receptacle and said second receptacle.

16. The method for fabricating a sound emitting inflatable ball of claim 9, further comprising the steps of:

securing said second receptacle to said periphery of said inflatable casing opposite said first receptacle.

17. A method for fabricating a sound emitting inflatable ball, comprising the steps of:

providing an inflatable casing;

securing a first receptacle to a periphery of said inflatable casing, securing a second receptacle to said periphery of said inflatable casing substantially opposite said first receptacle;

retaining at least one battery in one of said first and second receptacles, replacing said at least one battery by removing said at least one battery from one of said first receptacle and said second receptacle;

providing at least one of a sound emitting device and a light emitting device, triggering said sound emitting device with a shock sensor through a sound emitting circuit, triggering said light emitting device with said shock sensor through a light flashing circuit; and suspending at least one of said sound emitting device and said light emitting device in substantially a middle of said inflatable casing with at least two wires extending from said first and second receptacles.

18. The method for fabricating a sound emitting inflatable ball of claim 17, further comprising the steps of:

terminating an open end of said first receptacle with a first removable cap, extending one end of a first flexible hinge from a lip of said first receptacle, extending the other end of said first flexible hinge from said first removable cap, extending a first lift tab from said first removable cap; and terminating an open end of said second receptacle with a second removable cap, extending one end of a second flexible hinge from a lip of said second receptacle, extending the other end of said second flexible hinge from said second removable cap, extending a second lift tab from said second removable cap.

19. The method for fabricating a sound emitting inflatable ball of claim 17, further comprising the step of:

forming an air nozzle on a periphery of said inflatable casing, said air nozzle being insertable below the periphery of said inflatable casing.

20. The method for fabricating a sound emitting inflatable ball of claim 17, further comprising the steps of:

securing said second receptacle to said periphery of said inflatable casing opposite said first receptacle.

* * * * *